US007021909B1

(12) United States Patent
Steck

(10) Patent No.: US 7,021,909 B1
(45) Date of Patent: Apr. 4, 2006

(54) OSCILLATOR FOR PNEUMATIC PUMP HAVING SINGLE VALVE

(75) Inventor: Ricky B. Steck, West Jordan, UT (US)

(73) Assignee: Trebor International, Inc., West Jordan, UT (US)

( * ) Notice: Subject to any disclaimer, the term of this patent is extended or adjusted under 35 U.S.C. 154(b) by 390 days.

(21) Appl. No.: 10/621,062

(22) Filed: Jul. 16, 2003

(51) Int. Cl.
*F04B 17/00* (2006.01)
*F04B 35/00* (2006.01)

(52) U.S. Cl. ..... 417/393; 417/384; 137/107; 137/102

(58) Field of Classification Search ..... 417/384, 417/385, 393; 137/107, 102
See application file for complete search history.

(56) References Cited

U.S. PATENT DOCUMENTS 3,636,968 A * 1/1972 Tine ..... 137/102
3,652,187 A * 3/1972 Loeffler et al. ..... 417/393
3,653,393 A * 4/1972 Love ..... 137/102
3,741,689 A * 6/1973 Rupp ..... 417/393
4,303,088 A * 12/1981 Green et al. ..... 137/102
4,832,581 A * 5/1989 Muller et al. ..... 417/383
4,854,832 A * 8/1989 Gardner et al. ..... 417/393
5,326,234 A * 7/1994 Versaw et al. ..... 417/393
5,362,212 A * 11/1994 Bowen et al. ..... 417/395
5,607,290 A * 3/1997 Duncan ..... 417/393
5,707,217 A * 1/1998 Loeffler ..... 417/339
6,619,932 B1 * 9/2003 Murata ..... 417/395
6,644,940 B1 * 11/2003 Yamada ..... 417/393
6,644,941 B1 * 11/2003 Able et al. ..... 417/393
6,685,443 B1 * 2/2004 Simmons et al. ..... 417/395
6,767,189 B1 * 7/2004 Kleibrink ..... 417/53

* cited by examiner

*Primary Examiner*—William H. Rodriguez
(74) *Attorney, Agent, or Firm*—Workman Nydegger

(57) ABSTRACT

A pneumatic oscillator for providing pumping force to a pump. The oscillator has a single valve for controlling both the rate of oscillation of the oscillator and the flow of air. The valve includes a shuttle member and a detent mechanism. The detent mechanism controls the air flow in the oscillator and to the pump to which the oscillator is attached and the detent mechanism for regulating oscillation of the shuttle member. The configuration of the shuttle member and the detent mechanism eliminates the need for an additional valve to regulate oscillation of the oscillator. A cycle controller corresponding with the detent mechanism is adapted to change the rate of oscillation of shuttle member such that the need for additional valves or controllers for regulating the rate of oscillation is obviated.

32 Claims, 9 Drawing Sheets

OSCILLATOR FOR PNEUMATIC PUMP HAVING SINGLE VALVE

BACKGROUND OF THE INVENTION

1. The Field of the Invention

The present invention relates to mechanical oscillators. More particularly, the present invention relates to pneumatic oscillators for providing pumping force and controlling the cycle rate of a pump to which the oscillator is connected.

2. The Relevant Technology

Pneumatic oscillators have been utilized for many years as a mechanism to both provide pumping force and to control the rate of oscillation of diaphragm and bellows pumps. The simplistic design of oscillators is well suited for applications requiring low cost, high durability, and continuous operation of the pumping mechanism. Traditional pneumatic oscillators utilize a control valve, such as a spool valve, for controlling air flow and a trip valve for controlling the rate of oscillation of the oscillator. A variety of types and configurations of trip valves and control valves have been developed for a variety of situations and applications. In standard mechanical applications the use of both a control valve and a trip valve adds little additional cost to the overall components of an oscillator.

However, where the marginal cost of the oscillator is particularly important, or where the components of the oscillator are expensive to produce due to design requirements of specialized applications, the cost of each component can be an important consideration in the manufacture of an oscillator. For example, in ultra-pure manufacture settings, the materials and manufacture specifications for pump components can substantially increase the cost of each component utilized. Moreover, in situations in which relatively small pumps are required, the use of oscillators having conventional designs, with both control valves and trip valves, requires more space than is desirable.

Ultra-pure manufacture requirements are utilized in semiconductor and other manufacturing settings where contamination of a pumped fluid can result in the loss of hundreds of thousands or even millions of dollars of product or lost production in a short amount of time. To eliminate the possibility of contamination, pumping components, such as an oscillating valve, are constructed of non-reactive materials to provide the stability, reliability, and corrosion resistance needed to pump the highly reactive materials under extreme temperatures and pressure. The manufacturing challenges presented by typical non-reactive materials can substantially increase the cost of each component utilized.

BRIEF SUMMARY OF THE INVENTION

The present invention relates to pneumatic oscillators for providing pumping force to a pump. The oscillator includes a single valve for both controlling oscillation of the oscillator and for controlling flow of air. The valve comprises a shuttle member and an adjustable detent mechanism. The shuttle member controls the air flow in the oscillator and to the pump to which the oscillator is attached. The detent mechanism is adapted to regulate oscillation of the shuttle member. The configuration of the shuttle member and the detent mechanism eliminates the need for additional valves to regulate oscillation of the oscillator.

According to one aspect of the present invention, the oscillator comprises a first compression chamber, a second compression chamber, and a channel positioned between the first and second compression chambers. A shuttle valve is configured such that a portion thereof is positioned in a channel between the first and second chamber. The shuttle valve includes a shuttle member and a detent mechanism. The shuttle valve is adapted to control pressurization and depressurization of the first and second compression chambers so as to create a differential in air pressure between the first and second compression chambers. The detent mechanism is flexibly coupled to the shuttle member, which allows movement of the shuttle member only when the differential in air pressure reaches an adjustable threshold level.

According to one aspect of the present invention, an air source is adapted to provide pneumatic pressure to pressurize alternately the first and second compression chambers, which creates a differential in air pressure between the first and second compression chambers. The oscillator utilizes a single air source for pressurizing alternately the first and second compression chambers and for providing pumping force to the pump to which the oscillator is coupled. The air source provides a constant air flow to the oscillator, while the detent mechanism is utilized to regulate the rate of oscillation of the oscillator.

According to another aspect of the present invention, the oscillator includes a cycle controller. The cycle controller is adapted to change the rate of oscillation of the shuttle member such that the need for additional valves or controllers for regulating the rate of oscillation is obviated. The cycle controller corresponds with the detent mechanism of the shuttle valve.

These and other features and advantages of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The present invention relates to pneumatic oscillators for providing pumping force to a pump. The oscillator includes a single valve for both controlling oscillation of the oscillator and for controlling flow of air. The valve comprises a shuttle member and a detent mechanism. The shuttle member controls air flow to the oscillator and to the pump to which the oscillator is attached. The detent mechanism is adapted to regulate oscillation of the shuttle member. The configuration of the shuttle member and the detent mechanism eliminates the need for additional valves to regulate oscillation of the oscillator.

Figure 1:
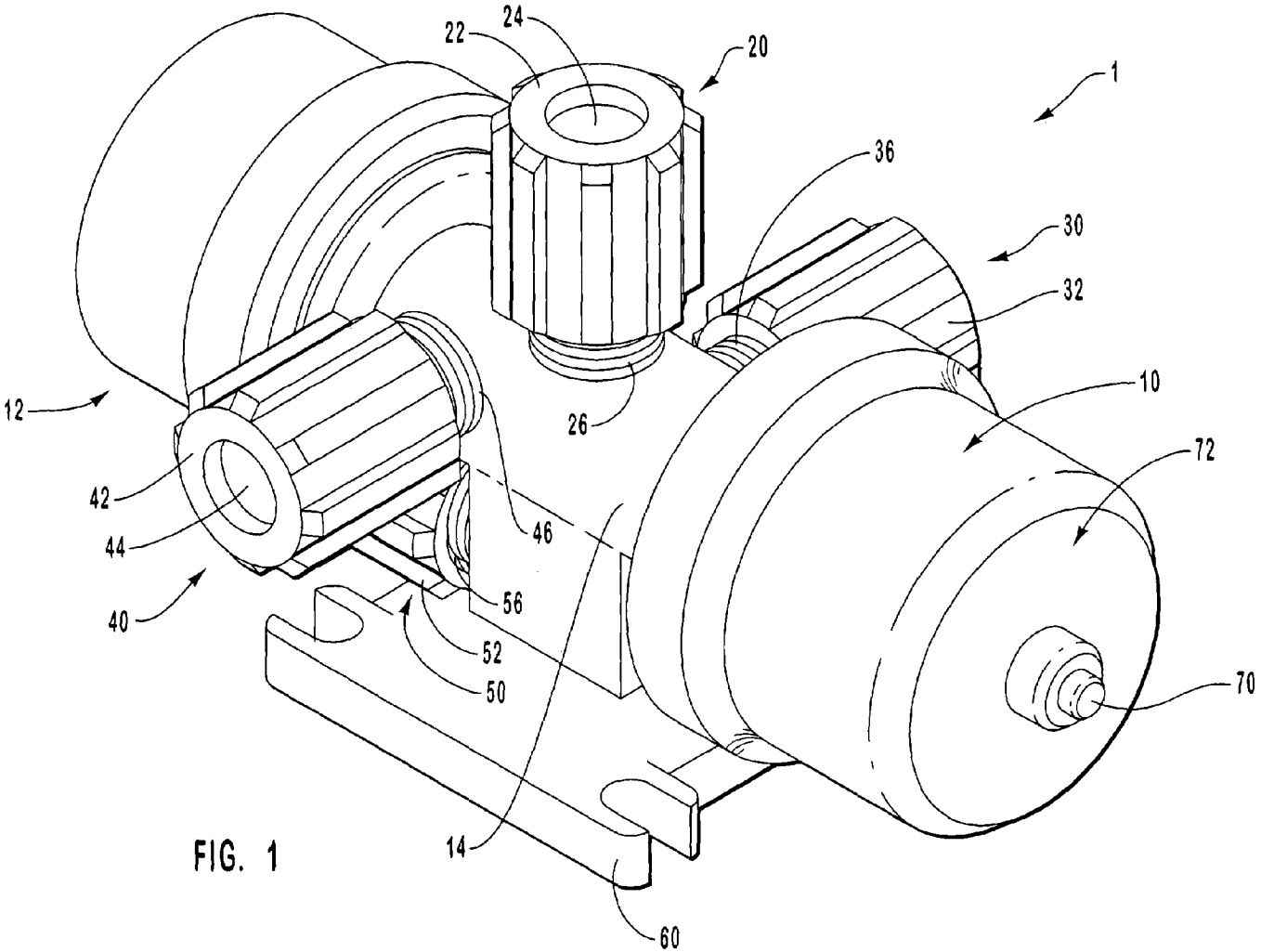
FIG. 1 is a perspective view of the oscillator according to one aspect of the present invention.

FIG. 1 illustrates an oscillator 1 that utilizes air flow for providing pumping force to a pump and controls cycling of the pump. The oscillator includes a first head 10, a second head 12, an oscillator body 14, an air inlet 20, a first supply port 30, a second supply port 40, and an exhaust port 50. First head 10 and second head 12 are configured to alternatively be pressurized and depressurized to regulate oscillation of oscillator 1. Oscillator body 14 is coupled between first head 10 and second head 12 and is configured to hold a valve for regulating pressurization and depressurization of first head 10 and second head 12 as well as oscillation of the oscillator 1.

Air inlet 20, first supply port 30, second supply port 40, and exhaust post 50 function as conduits for the air that drives oscillator 1 as well as the air that is provided to the pump coupled to oscillator 1. In the illustrated embodiment, air inlet 20 is coupled to the top of oscillator body 14. Air inlet 20 provides the air pressure necessary to power oscillator 1 as well as the pumping force needed to drive the pump coupled to oscillator 1. Air inlet 20 includes a coupler 22, a bore 24, and a threaded mount 26. Coupler 22 is configured to be positioned on threaded mount 26. Coupler 22 is adapted to connect air inlet 20 to an air pressure delivery source such as tubing, an air conduit, or other source of air flow. Bore 24 is positioned in the top of coupler 22 and is configured to allow air to be delivered from an air delivery source to oscillator 1. Threaded mount 26 is coupled to oscillator body 14 and provides a mechanism by which coupler can be connected to oscillator body 14. As will be appreciated by those skilled in the art, a variety of types and configurations of air inlet 20 may be utilized without departing from the scope or spirit of the present invention. For example, in one embodiment, air inlet 20 is configured to be integrally coupled to tubing leading to an air pressure source.

First supply port 30 is coupled to the right side of oscillator body 14 and is configured to provide air pressure to a compression chambers of a pump that is coupled to oscillator 1. First supply port 30 includes a coupler 32, a bore (not visible in the perspective view of FIG. 1), and a threaded mount 36. Coupler 32 is configured to be positioned on threaded mount 36 and is adapted to connect first supply port 30 to an air delivery mechanism, such as tubing, an air conduit, which delivers pressurized air to the pump with which the oscillator 1 is used. The bore associated with the first supply port 30 is positioned in the top of coupler 32 and is configured to allow air to be delivered from oscillator 1 to the pump coupled to oscillator 1. Although the bore associated with the first supply port 30 is not visible in the perspective view of FIG. 1, its structure is similar to that of bore 24 associated with air inlet 20. Threaded mount 36 is coupled to oscillator body 14 and provides a mechanism by which coupler 32 can be connected to oscillator body 14. A variety of types and configurations of first supply port 30 can be utilized without departing from the scope or spirit of the present invention.

Second supply port 40 is coupled to the left side of oscillator body 14, or opposite the side having first supply port 30. Second supply port 40 is configured to provide air pressure to the other compression chamber of the pump that is coupled to oscillator 1. Second supply port 40 includes a coupler 42, a bore 44, and a threaded mount 46. Coupler 42 is configured to be positioned on threaded mount 46. Coupler 42 is adapted to connect second supply port 40 to an air delivery mechanism such as tubing, an air conduit, to deliver pressurized air to the pump with which the oscillator 1 is used. Bore 44 is positioned in the top of coupler 42 and allows air to be delivered from oscillator 1 to the pump to which oscillator 1 is coupled. Threaded mount 46 is coupled to oscillator body 14 and provides a mechanism by which coupler 42 can be connected to oscillator body 14. A variety of types and configurations of second supply port 40 can be utilized without departing from the scope or spirit of the present invention.

Exhaust port 50 is coupled to oscillator body 14 and is positioned beneath second head 12 of oscillator 1. Exhaust port 50 is configured to alternatingly exhaust air from first head 10 and second head 12. Additionally, exhaust port 50 is alternatingly exhaust air from the heads of the pump to which oscillator 1 is coupled. A more complete discussion of the functionality of exhaust port 50 and the manner in which it is utilized to allow exhaust of air pressure from the first and second heads 10 and 12 of oscillator 1 and first and second heads of the pump 2 to which oscillator 1 is coupled will be presented below with reference to FIGS. 4A, 4B, 4C, and 6.

In the illustrated embodiment, exhaust port 50 includes a coupler 52, a bore (not visible in the perspective view of FIG. 1), and a threaded mount 56. Coupler 52 is adapted to be connected to a leak detector to allow the user of the pump to ascertain whether the fluid being pumped by the pump is leaking into oscillator 1. Coupler 52 is configured to be positioned on threaded mount 56. The bore associated with the exhaust port 50 is positioned in the top of coupler 52 and is configured to allow a leak detector to determine whether fluid is leaking. Although the bore associated with the exhaust port 50 is not visible in the perspective view of FIG. 1, its structure is similar to that of bore 24 associated with air inlet 20 and the other bores described above in reference to FIG. 1. Threaded mount 56 is coupled to oscillator body 14 and provides a mechanism by which coupler 52 can be connected to oscillator body 14. A variety of types and configurations of exhaust port 50 can be utilized without departing from the scope and spirit of the present invention. For example, in one embodiment the exhaust port is an independent component from the leak detection port.

In the illustrated embodiment, oscillator 1 includes a base mount 60, which can be used to couple oscillator 1 to the pump. In an alternative embodiment, base mount 60 is configured to provide a mechanism for stabilizing oscillator 1 by coupling base mount 60 to a stationary surface. As will be appreciated by those skilled in the art a variety of types and configurations of mounts, bases, and/or securing members can be utilized to secure oscillator 1 without departing from the scope or spirit of the present invention. Additionally, in alternative embodiments no base, mount, or securing members need to be utilized due to the matter in which oscillator is coupled to a pump.

FIG. 1 also illustrates a cycle controller 70 and indicia 72. In the illustrated embodiment, cycle controller 70 is integrally connected to first head 10, and allows the user of the pump to control the rate of oscillation of oscillator 1. By manipulating cycle controller 70 the user can increase or decrease the rate of oscillation of oscillator 1, thus effectively controlling the cycling of the pump to which oscillator 1 is coupled. Indicia 72 is also integrally coupled to first head 10 in the embodiment of FIG. 1, and provides the user with a visual indication of the manner in which to manipulate cycle controller 70 so as to properly regulate oscillation of oscillator 1. In the illustrated embodiment, indicia comprises visual indications of the direction in which to manipulate cycle controller 70 to increase or decrease the rate of oscillation. In an alternative embodiment, indicia 72 comprises a electrical or electromechanical device coupled to a display to indicate the actual or estimated rate of oscillation.

As will be appreciated by those skilled in the art, a variety of types and configurations of oscillators can be utilized without departing from the scope or spirit of the present invention. For example, in one embodiment, the oscillator is configured to utilize hydraulic pressure instead of air pressure. In an alternative embodiment, a single supply port is configured to provide the pumping force needed to drive the pump coupled to the oscillator.

Figure 2:
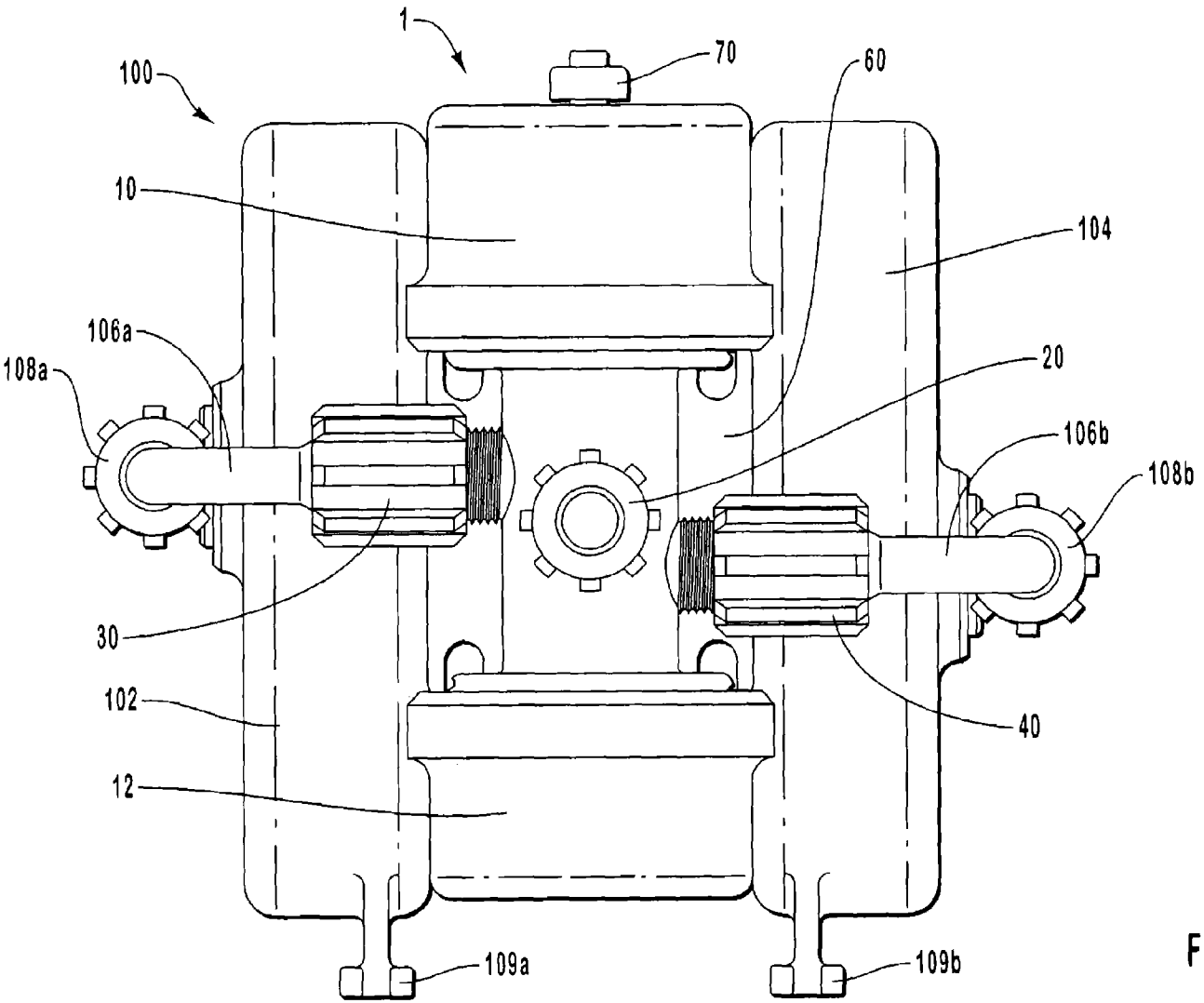
FIG. 2 is a top view showing the oscillator coupled to a pump according to one aspect of the present invention.

FIG. 2 illustrates oscillator 1 (foreground) coupled to a pump 100 (background) according to one embodiment of the present invention. FIG. 2 also shows tubing 106A and 106B, couplers 108A and 108B, and base members 109A and 109B. Pump 100 is configured to utilize air flow supplied by oscillator 1 to displace fluid from one location to a different location. A variety of types and configurations of pumps can be utilized without departing from the scope and spirit of the present invention. For example, in one embodiment, the pump can be a diaphragm pump in which diaphragms separate the air pressure chamber from the fluid being pumped. While any of a variety of pumps can be powered and controlled using the oscillators of the invention, examples of suitable diaphragm pumps are disclosed in U.S. Pat. No. 6,106,246, entitled "Free-Diaphragm Pump", which is incorporated herein by reference.

Pump 100 includes a first pump head 102 and a second pump head 104, which provide the pumping force required to displace the fluid that is to be pumped. In operation, first pump head 102 and second pump head 104 are alternatingly pressurized and depressurized to cause the pump to cycle and to pump the fluid.

As previously mentioned, oscillator 1 supplies the air flow to pump 100 required to displace the fluid. Oscillator 1 also controls the rate of cycling of pump 100. As can seen from FIG. 2, first supply port 30 is coupled to first pump head 102 by tubing 106*a* and coupler 108*a*. Second supply port 40 is coupled to second pump head 104 by tubing 106*b* and coupler 108*b*. First pump head 102 is pressurized by means of air flow delivered to first pump head 102 from first supply port 30. Similarly, second pump head 104 is pressurized by means of air flow delivered to second pump head 104 from second supply port 40. First supply port 30 and second supply port 40 also provide a mechanism for alternatively exhausting the pressurized air in the first pump head 102 and second pump head 104 so as to depressurize first pump head 102 and second pump head 104.

First supply port 30 and second supply port 40 alternatingly pressurize and depressurize first pump head 102 and second pump head 104. For example, at a given point in time during operation of the pump, first pump head 102 may be undergoing pressurization by first supply port 30 while second pump head 104 is being depressurized by second supply port 40. A more complete description of the manner in which first supply port 30 and second supply port 40 can be utilized to both pressurize and depressurize first pump head 102 and second pump head 104 is presented below with reference to FIGS. 3 and 4.

Figure 3:
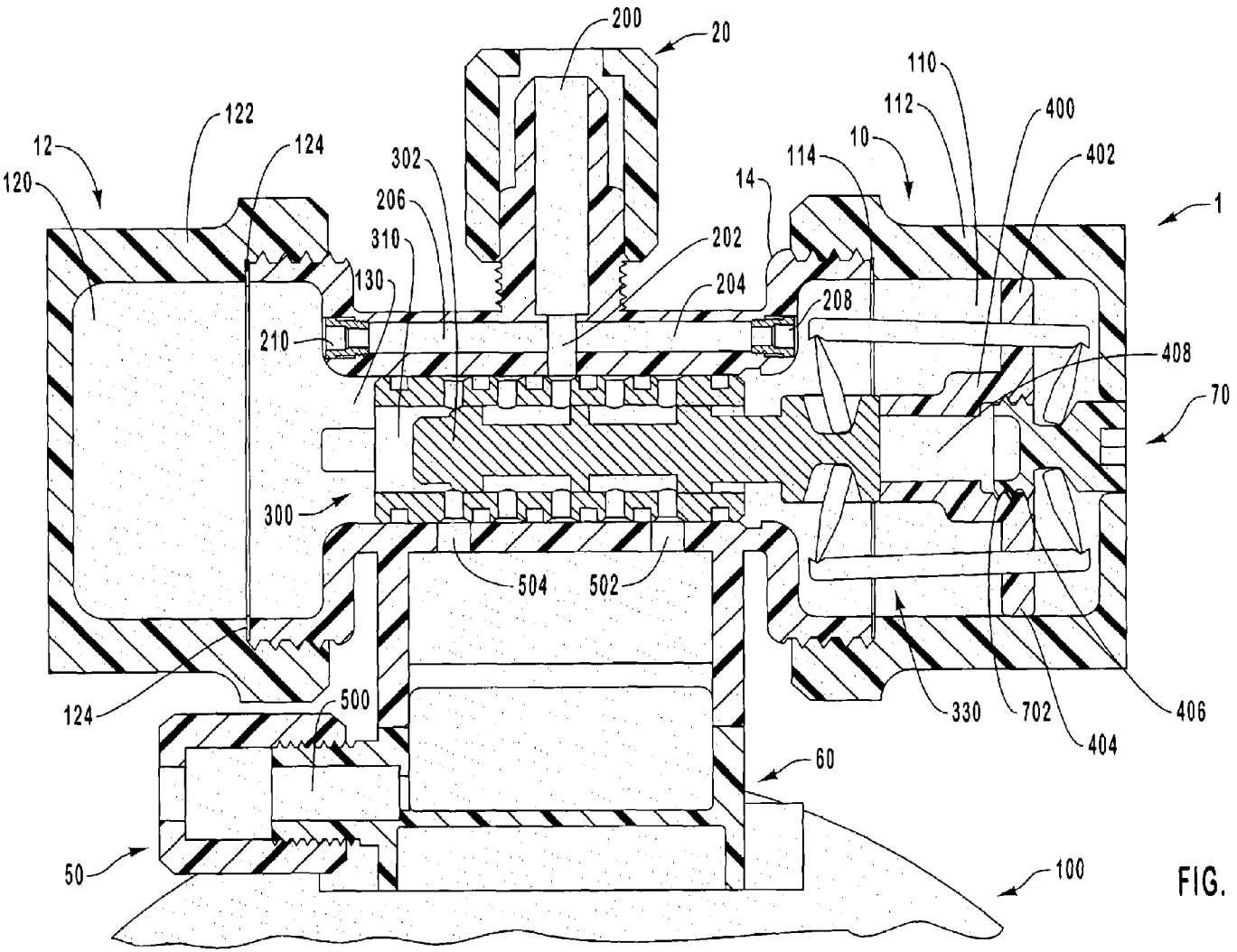
FIG. 3 is a side cut-away view of the oscillator illustrating the shuttle valve and the first and second compression chamber according to one aspect of the present invention.

FIG. 3 illustrates a shuttle valve 300 of oscillator 1 and the manner in which shuttle valve 300 can be utilized to regulate the air flow in, and between, oscillator 1 and pump 100. As discussed with reference to FIG. 1, oscillator 1 includes a first head 10, a second head 12, an air inlet 20, an oscillator body 14, an exhaust port 50, and a cycle controller 70. The functionality provided by first head 10, second head 12, oscillator body 14, air inlet 20, exhaust port 50, and cycle controller 70 facilitates the control of air flow in oscillator 1.

First head 10 includes a first compression chamber 110, a first chamber casing 112, and a seal 114. Compression chamber 110 is configured to be pressurized and depressurized to provide part of the pneumatic pressure needed to cause oscillator 1 to reciprocate. In a preferred embodiment, first compression chamber 110 includes a sealed pneumatic chamber preventing unregulated entrance and escape of air. First chamber casing 112 is a housing that defines the volume of first compression chamber 110 and provides the structural strength to sustain repeated pressurization of first compression chamber 110, while also providing impact resistance to protect first compression chamber 110 from the external environment.

First chamber casing 112 is coupled to oscillator body 14. In the illustrated embodiment a threaded coupling is provided between oscillator body 14 and first chamber casing 112. Seal 114 is disposed between the point of coupling between first chamber casing and oscillator body 114. Seal 114 is configured to provide an air tight barrier to the external environment at the point of coupling between first chamber casing 112 and oscillator body 14.

Second head 12 includes a second compression chamber 120, a second chamber casing 122, and a seal 124. Compression chamber 120 is configured to be pressurized and depressurized to provide the force needed to oscillate oscillator 1. In a preferred embodiment, second compression chamber 120 includes a sealed pneumatic chamber preventing unregulated entrance and escape of air from second compression chamber 120. Second chamber casing 122 is a housing that defines the volume of second compression chamber 120 and provides the structural strength needed to maintain pressurization of second compression chamber 120, while also providing impact resistance to protect second compression chamber 120 from the external environment.

Second chamber casing 122 is coupled to oscillator body 14. In the illustrated embodiment, a threaded coupling engages oscillator body 14 with second chamber casing 122. Seal 124 is disposed between the point of coupling between first chamber casing and oscillator body 14. Seal 124 is forms an air-tight barrier to the external environment at the point of coupling between second chamber casing 122 and oscillator body 14.

Oscillator body 14 is positioned between first head 10 and second head 12. In the illustrated embodiment, oscillator body 14 is coupled directly to first chamber casing 112 and second chamber casing 122. Oscillator body 14 includes a shuttle channel 130 that forms a conduit between first compression chamber 110 and second compression chamber 120 so as to allow shuttle valve 300 to be positioned and to move longitudinally therein.

As previously mentioned, air inlet 20 provides access to an air pressure source external to oscillator 1. Air inlet 20 includes an inlet lumen 200, which conducts air from the air pressure source to the internal components of oscillator 1. A first pressure chamber inlet 204 and a second pressure chamber inlet 206 are in direct fluid connection with inlet lumen 200 by means of needle valve 202, which provides resistance to air flow from inlet lumen 200 and to first pressure chamber inlet 204 and second pressure chamber inlet 206. In this manner, needle valve 202 provides a substantially constant rate of air flow from inlet lumen 200 to first pressure chamber inlet 204 and to second pressure chamber inlet 206. In the illustrated embodiment, first pressure chamber inlet 204 and second pressure chamber inlet 206 are positioned internally within oscillator body 14 so as to provide a channel between inlet lumen 200 and first compression chamber 110 and second compression chamber 120. Thus, air pressure from an air pressure source is delivered to first compression chamber 110 by means of first pressure chamber inlet 204. Air pressure from the air pressure source is delivered to second compression chamber 120 by means of second compression chamber inlet 206.

Restrictors 208 and 210 are positioned within first pressure inlet 204 and second pressure inlet 206, respectively. The restrictors have a bore diameter that restricts the air flow into the corresponding pressure chambers. The restrictors 208 and 210 can be press-fitted into the corresponding pressure inlets and can have a bore diameter that is selected to establish the range of speeds at which the oscillator can operate. The bore diameters and the related speed ranges are based on the dimensions of the other components of the oscillator and the pump as well as on the air pressures that can be obtained. In general, a smaller bore diameter reduces the air flow and the oscillator speed range. In one example, a bore diameter of 0.020 inches produces a range of 20 to 180 cycles per minute, while a bore diameter of 0.024 inches produces a range of 45 to 350 cycles per minute.

FIG. 3 also illustrates shuttle valve 300. which is positioned in shuttle channel 130 and in first head 110 of oscillator 1. Shuttle valve 300 controls the air flow from air inlet 20 and regulates oscillation of oscillator 1. The configuration of shuttle valve 300 eliminates the need for additional valves to regulate operation of oscillator 1. Shuttle valve 300 includes a shuttle member 302, a valve body 310, and a detent mechanism 330. A portion of shuttle member 302 is positioned internal to shuttle channel 130. Shuttle valve sleeve 310 is positioned internally within shuttle channel 130 and around shuttle member 302. Detent mechanism 330 is positioned internally within first head 110 and is in contact with the end of shuttle member 302 that extends into first head 110 of oscillator 1. Shuttle valve 300 is one example of a single valve that eliminates the need for an additional valve to control oscillation of the oscillator. A variety of types and configurations of valves can be utilized without departing from the scope or spirit of the present invention. For example, a detent mechanism can positioned laterally to a spool valve to cooperatively regulate the air flow while controlling oscillation of the shuttle valve.

Shuttle member 302 controls the air flow by oscillating between a first position and a second position. Valve body 310 include a plurality of ports that function as conduits of air to regulate air flow in oscillator 1. The configuration of the ports permits shuttle member 302 to regulate the air flow during cycling of the pump. Detent mechanism 330 regulates the speed of oscillation of shuttle member 302. The configuration of shuttle member 302, valve body 310, and detent mechanism 330 eliminates the need for additional valves to regulate operation of oscillator 1. A more complete discussion of shuttle valve 300 will be presented below with reference to FIGS. 4A, 4B, and 4C, 5A and 5B, and 6.

FIG. 3 also shows a plate member 400 that is positioned internally within first head 10 of oscillator 1. Plate member 400 can be adjusted to apply tension, or pretension, to detent mechanism 330 in cooperation with cycle controller 70, which regulates the rate of oscillation of shuttle valve 300. Plate member 400 includes a plate apex 402, a plate bottom 404, threads 406, and a central bore 408. A more complete discussion of the use of cycle controller 70 and plate member 400 to regulate the rate of oscillation of shuttle valve 300 is presented in greater detail with reference to FIGS. 5A and 5B.

As previously discussed, exhaust port 50 exhausts air pressure from first compression chamber 110, second compression chamber 120, and pump 100. Exhaust port 50 includes an exhaust outlet lumen 500, which forms a conduit connecting the internal components of oscillator 1 to the external environment. Exhaust outlet lumen 500 is in fluid communication with exhaust outlet apertures 502 and 504. Exhaust outlet apertures 502 and 504 are in direct fluid communication with the exhaust ports of valve body 310. A more complete discussion of the use of exhaust port 50, exhaust outlet lumen 500, exhaust outlet aperture outlet 502, and exhaust outlet aperture 504, will be presented in greater detail with references to FIGS. 4A, 4B, and 4C.

Figure 4A:
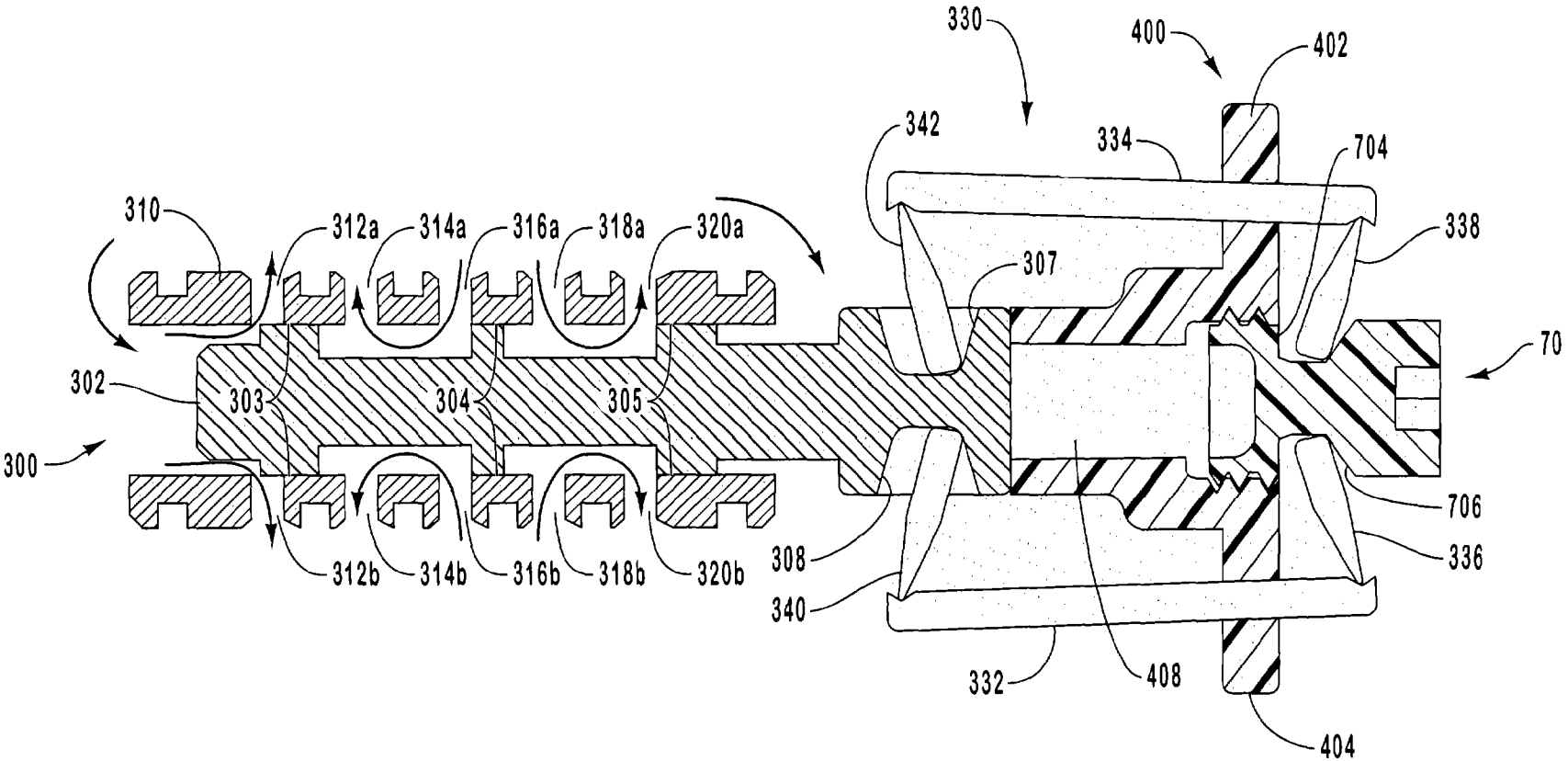
FIG. 4A is a side cut-away view of the shuttle valve illustrating the shuttle valve in a first position.

With reference now to FIG. 4A, there is shown shuttle valve 300, cycle controller 70, and plate member 400 in greater detail according to one embodiment of the present invention. As noted above, shuttle valve 300 includes shuttle member 302, valve body 310, and detent mechanism 330. Shuttle member 302 oscillates between a first and second position so as to regulate pressurization and depressurization of first compression chamber 110 and second compression chamber 120, as well as to regulate pressurization and depressurization of first pump head 102 and second pump head 104. Shuttle member 302 includes a first land 303, a second land 304, a third land 305, an actuation leg notch 307, and an actuation leg notch 308. First land 303, second land 304, and third land 305 conform to the internal diameter of valve body 310 so as to form a seal with an internal surface of valve body 310. First land 303, second 304, and third land 305 have a larger diameter than the portions of shuttle member 302 adjacent to first land 303, second land 304, and third land 305. By having a greater diameter than the adjacent segments, first land 303, second land 304, and third land 305 prevent air flow or bleeding of pressurized air across lands 303, 304, and 305.

Actuation leg notch 307 and actuation leg notch 308 couple shuttle member 302 to detent mechanism 330. The notch configuration of actuation leg notches 307 and 308 allow shuttle member 302 to be flexibly coupled to detent mechanism 330, thus allowing for movement of shuttle member 302 relative to detent mechanism 330.

Valve body 310 forms a cylindrical shaft surrounding shuttle member 302. Valve body 310 is configured to enable the air inlet 20 and the exhaust port 50 to have direct fluid communication with first compression chamber 110, second compression chamber 120, first pump head 102, and second pump head 104. Valve body 310 includes valve exhaust port 312, valve pump supply port 314, valve inlet port 316, valve pump supply port 318, and valve exhaust port 320. In the illustrated embodiment, each valve port includes a plurality of apertures that are in fluid communication with various components of oscillator 1, pump 100, and the external environment. For example, in FIG. 4A, valve exhaust port 312 includes apertures 312A and 312B; valve pump supply port 314 includes apertures 314A and 314B; valve inlet port 316 includes apertures 316A and 316B; valve pump supply port 318 includes apertures 318A and 318B; and valve exhaust port 320 includes apertures 320A and 320B.

Due to the cross sectional view of valve body 310 of the illustrated embodiment apertures 312A, 312B, 314A, 314B, 316A, 316B, 318A, 318B, 320A, and 320B are shown. It will be appreciated that a plurality of additional apertures can be included in valve body around its circumference. Valve exhaust port 312 and valve exhaust port 320 are positioned to be in fluid communication with exhaust port 50. Valve pump supply port 314 is positioned to be in fluid communication with second supply port 40 and second pump head 104 of pump 100. Valve inlet port 316 is positioned to be in fluid communication with air inlet 20 and correspondingly with an air pressure source. Valve pump supply port 318 is positioned to be in fluid communication with first supply port 30 and first pump head 102 of pump 100.

FIG. 4A illustrates the shuttle member 302 at one position in its cycle, in which the shuttle member is at its rightmost displacement. In this position, first land 303 is positioned to the right of valve exhaust port 312, effectively sealing valve exhaust port 312 from valve pump supply port 314 and valve inlet port 316. Second land 304 is positioned to the right of valve inlet port 316 and to the left of valve pump supply port 318, effectively sealing valve inlet port 316 from valve pump supply port 318 and valve exhaust port 320. Third land 305 is positioned to the right of valve exhaust port 320, effectively sealing valve exhaust port 320 from first compression chamber 110.

Due to the position of first land 303, valve exhaust port 312 is in direct fluid communication with second compression chamber 120 at the position of the shuttle member 302 of FIG. 4A. In this position, air pressure in second compression chamber is exhausted through valve exhaust port 312 to exhaust port 50, effectively depressurizing second compression chamber 120. Due to the position of first land 303 and second land 304, valve pump supply port 314 is in direct fluid communication with valve inlet port 316. In this position, air pressure from an air pressure source flows from valve inlet port 316 to valve pump supply port 314, effectively pressurizing second pump head 104 of pump 100.

Due to the positions of second land 304 and third land 305, valve pump supply port 318 is in direct fluid communication with valve exhaust pot 320. Thus air pressure in first pump head 102 of pump 100 flows from first pump head 102 through valve pump supply port 318 to valve exhaust port 320 and further to exhaust port 50, effectively depressurizing first pump head 102.

The position of third land 305 in FIG. 4A effectively seals first compression chamber 110 from valve exhaust port 320. Because air is flowing from an air source to inlet lumen 200 of air inlet 20 through first pressure chamber inlet 204 to first compression chamber 110, first compression chamber 10 is being pressurized. Also, when the shuttle member 302 is in the position of FIG. 4A, the position of first land 303 puts second compression chamber 120 in direct fluid communication with valve exhaust port 312, effectively depressurizing second compression chamber 120.

Thus, when shuttle valve 300 is in the position of FIG. 4A, first compression chamber 110 is being pressurized while second compression chamber 120 is being depressurized. Similarly, second pump head 104 is being pressurized while first pump head 102 of pump 100 is being depressurized. As will discussed with reference to FIGS. 4B and 4C as shuttle member 302 oscillates to a second position, the pressurization and depressurization of first pump head 102 and second pump head 104 of pump 100 and the pressurization and depressurization of first compression chamber 110 and second compression chamber 120 of oscillator 1 is reversed, causing oscillation of oscillator 1 and cycling of pump 100. The oscillation of oscillator 1 and the cycling of pump 100 regulate the pumping of fluid flowing through pump 100.

Detent mechanism 330 is coupled to shuttle member 302 and controls the rate of oscillation of shuttle member 302. Detent mechanism 330 includes a first resilient member 332, a second resilient member 334, a first pretension leg 336, a second pretension leg 338, a first actuation leg 340, and a second actuation leg 342. First resilient member 332 and second resilient member 334 exert pressure on first pretension leg 336, second pretension leg 338, first actuation leg 340, and second actuation leg 342.

First resilient member 332 and second resilient member 334 are coupled to plate member 400. First resilient member 332 is coupled to plate member 400 near plate bottom 404. Second resilient member 334 is coupled to the portion of plate member 400 near plate apex 402. First pretension leg 336 and second pretension leg 338 are positioned so as to exert a force against first resilient member 332 and second resilient member 334. Similarly, first actuation leg 340 and second actuation leg 342 are also configured to exert a force against first resilient member 332 and second resilient member 334.

The configuration of first resilient member 332, second resilient member 334, first pretension leg 336, second pretension leg 338, first actuation leg 340, and second actuation leg 342 results in a predetermined amount of tension being exerted from first resilient member 332 on first actuation leg 340 and second resilient member 334 on second actuation leg 342. The tension on first actuation leg 340 and second actuation leg 342 results in a force being exerted on shuttle member 302. In the illustrated embodiment, the position of first actuation leg 340 and second actuation leg 342 results in a force being exerted on shuttle member 302 in the direction of plate member 400. Absent an offsetting force, the force exerted in the direction of plate member 400 maintains the position of shuttle member 302 in its rightmost displacement.

As first compression chamber 110 is pressurized and second compression chamber 120 is depressurized, the differential in air pressure between first compression chamber 110 and second compression chamber 120 increases. As the pressure differential between first compression chamber 110 and second compression 120 increases, the differential in air pressure tends to force shuttle member 302 in the direction of second compression chamber 120. When the force exerted on shuttle member 302 by the air pressure differential exceeds the force exerted on shuttle member 302 by detent mechanism 330, shuttle member 302 begins to move in the direction of second compression chamber 120. The movement of shuttle member 302 during this process will be discussed in greater detail with references to references 4B and 4C.

Figure 4B:
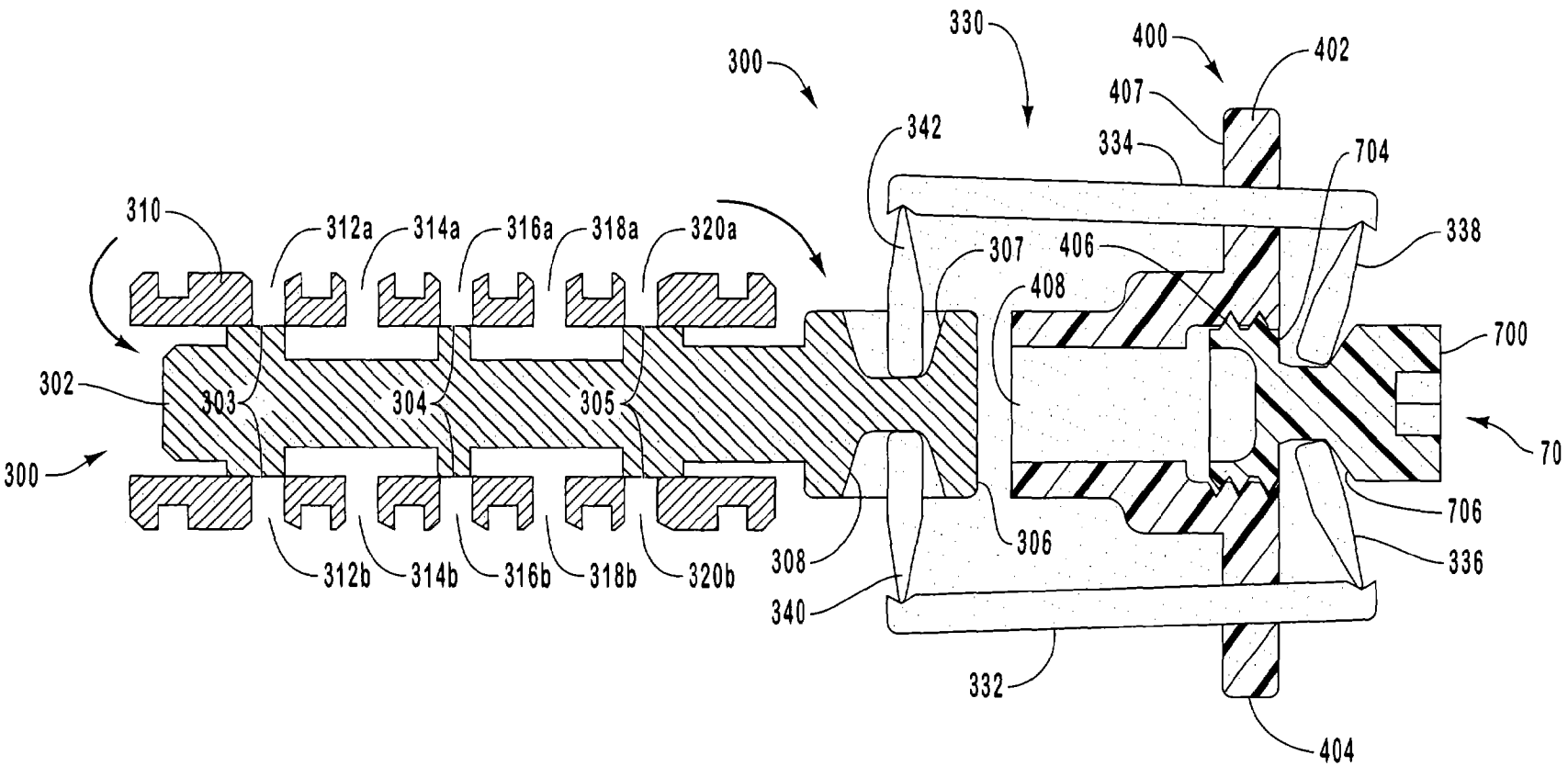
FIG. 4B is a side cut-away view of the shuttle valve illustrating the shuttle valve in an intermediate position according to one aspect of the present invention.

With reference now to FIG. 4B, the position of shuttle member 302 and detent mechanism 330 at another point during the cycle is illustrated. At this point, shuttle member 302 is moving from the first position at its rightmost displacement to the second position at its leftmost displacement. In this position, the differential in air pressure between first compression chamber 110 and second compression chamber 120 forces shuttle member 302 to move between the first and second positions. The current position of shuttle member 302 in FIG. 4B is an intermediate position and represents a state of movement between a first and second position. The represented position can be the result of moving from a second position from its leftmost displacement to the first position at its rightmost displacement or vice versa.

While in the illustrated position, the fourth land 306 of shuttle member 302 has some separation from cycle controller member 700. First actuation leg 340 and second actuation leg 342 are in a substantially upright position due to the repositioning of actuation leg notch 307 and actuation leg notch 308. In this position, the separation between the shuttle member 302 and both the first resilient member 332 and second resilient member 334 is at its greatest.

Due to the configuration of first actuation leg 340 and second actuation leg 342, when shuttle member 302 reaches the position in which first actuation leg 340 and second actuation leg 342 are substantially upright, shuttle member 302 will continue to shift to the opposite extreme displacement. Thus, detent mechanism 330 maintains shuttle member 302 in a given position until the pressure differential between first compression chamber 110 and second compression chamber 120 reaches a threshold level. The threshold level corresponds with the point at which the force exerted by the pressure differential between first compression chamber 110 and second compression chamber 120 exceeds the force exerted by detent mechanism 330.

Once the threshold level has been reached or exceeded, the shuttle member 302 begins to move in the direction of its opposite extreme displacement. When the pressure differential is sufficient to force shuttle member 302 to the illustrated position, shuttle member 302 will continue to move past the point at which first actuation leg 340 and second actuation leg 342 are in the substantially upright position and to a state of lower energy. Once shuttle member 302 has moved past this point, first actuation leg 340 and second actuation leg 342 will begin to exert a force on shuttle member 302 in the direction of movement, thus ensuring that shuttle member 302 will complete oscillation to the opposite extreme displacement.

While the position of shuttle member 302 in FIG. 4B represents a state of motion, it can be seen that the flow of air pressure is already affected by the change in position of the shuttle member 302 relative to the shuttle body 310. When shuttle member 302 is in the position illustrated in FIG. 4B, first land 303 blocks valve exhaust port 312, preventing further depressurization of second compression chamber 120. Second land 304 blocks valve inlet port 316, preventing further pressurization of second pump head 104. Third land 305 is positioned to block valve exhaust port 320, so as to prevent further depressurization of first pump head 102 and further pressurization of first compression chamber 110.

As previously discussed, the pressure differential between first compression chamber 110 and second compression chamber 120 continues to increase until the pressure exerted by detent mechanism 330 against movement of shuttle member 302 is overcome. Detent mechanism 330 begins to exert a force in the direction of movement resulting in repositioning of shuttle member 302 to the opposite extreme displacement.

Figure 4C:
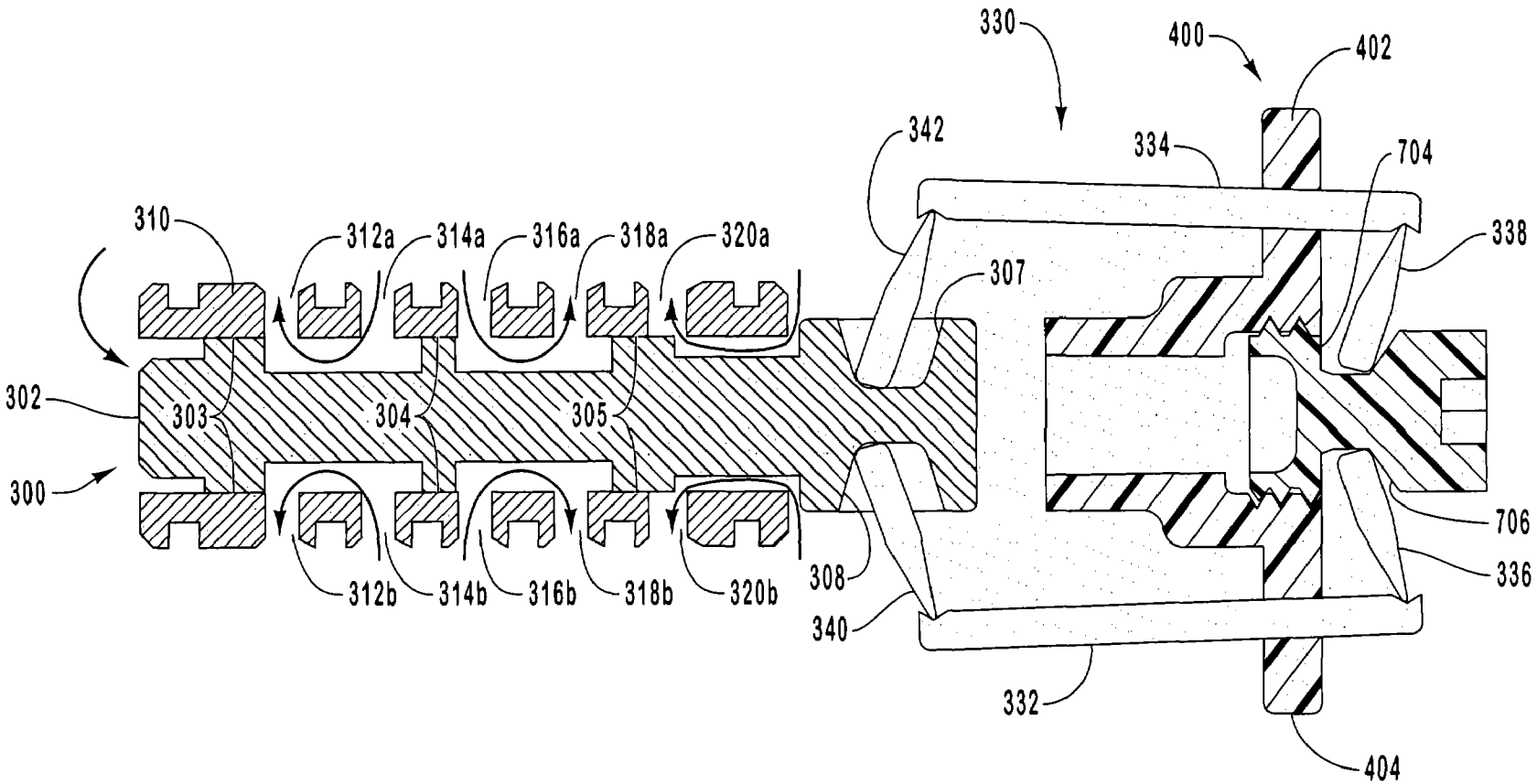
FIG. 4*c* is a side cut-away view of the shuttle valve illustrating the shuttle valve in a second position according to one aspect of the present invention.

FIG. 4C depicts shuttle member 302 in a second position at its leftmost displacement during the cycle of the oscillator. When shuttle member 302 is in this second position, detent mechanism 330 is configured such that first actuation leg 340 and second actuation leg 342 exert a force in the direction of second compression chamber 120, so as to inhibit movement of shuttle member 302 in the direction of first compression chamber 120. When shuttle member 302 is in the second position, first land 303 is positioned to the left of valve exhaust port 312, effectively isolating second compression chamber 120 from valve exhaust port 312.

Because second compression chamber is coupled to inlet lumen 200 of air inlet 20 by means of second pressure chamber inlet 206, second compression chamber 120 begins increasing in pressure. First compression chamber 110 is also coupled to inlet lumen 200 of air inlet 20 via first pressure chamber inlet 204. However, the position of third land 305 to the left of valve exhaust port 320 is such that first compression chamber 110 is continually exhausted, effectively depressurizing first compression chamber 110. Thus, it can be seen that when shuttle member 302 is in second position, the pressurization and depressurization of first compression chamber 110 and second compression chamber 120 are reversed from when shuttle member 302 is in the first position.

When shuttle member 302 is in the second position, second land 304 is positioned between valve pump supply port 314 and valve inlet port 316, effectively sealing valve pump supply port 314 from valve inlet port 316. As a result, valve pump supply port 314 is in direct fluid communication with valve exhaust port 312, resulting in depressurization of second pump head 104. Second pump head 104 is depressurized because valve pump supply port 314 is in direct fluid communication with both second pump head 104 and valve exhaust port 312.

When shuttle member 302 is in the second position as illustrated in FIG. 4C, third land 305 is positioned to the right of valve pump supply port 318 and to the left of valve exhaust port 320. As a result, valve pump supply port 318 is in direct fluid communication with valve inlet port 316. Due to the fact that valve pump supply port 318 is in direct fluid communication with first pump head 102, the direct fluid coupling between valve pumps supply port 318 and valve inlet port 316 results in pressurization of first pump head 102. Similarly, because first compression chamber 110 is in direct fluid communication with valve exhaust port 320, first compression chamber 110 is depressurized. Thus, the configuration of shuttle valve 300 eliminates the need for additional valves to regulate of airflow of oscillator 1 and of pump 100.

Figure 5A:
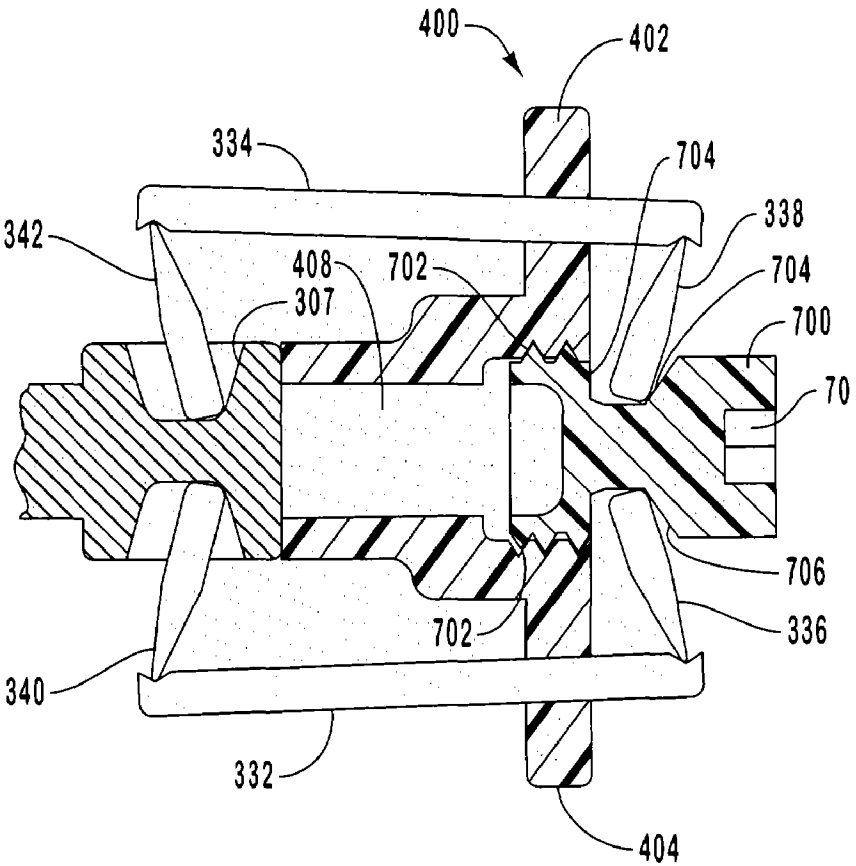
FIGS. 5A and 5B are side cut-away views illustrating the manner in which the cycle controller can be utilized with the detent mechanism to regulate oscillation of the shuttle member according to one aspect of the present invention.

FIG. 5A illustrates the manner in which cycle controller 70 can be utilized with detent mechanism 330 to regulate oscillation of shuttle member 302 and, consequently, oscillation of oscillator 1. Cycle controller 70 is coupled to first chamber casing 112. A portion of cycle controller 70 is exposed to the external surface of oscillator 1, while a portion is positioned internally within first compression chamber 110. Cycle controller 70 includes second controller member 700, a threaded base 702, a pretension leg notch 704, and pretension leg notch 706.

Second controller member 700 comprises the body of cycle controller 70. Threaded base 702 is threaded communication with threads 406 of plate member 400. By rotating cycle control member 700, thread base 702 is rotated relative to threads 406 and plate member 400, increasing or decreasing the displacement between cycle controller member 700 and shuttle member 302. By increasing displacement between cycle controller member 700 and shuttle member 302, first pretension leg 336 and second pretension leg 338 are moved into a more perpendicular position relative to resilient members 332 and 334, thus increasing the tension of first resilient member 332 and second resilient member 334 (See FIG. 5B).

Figure 5B:
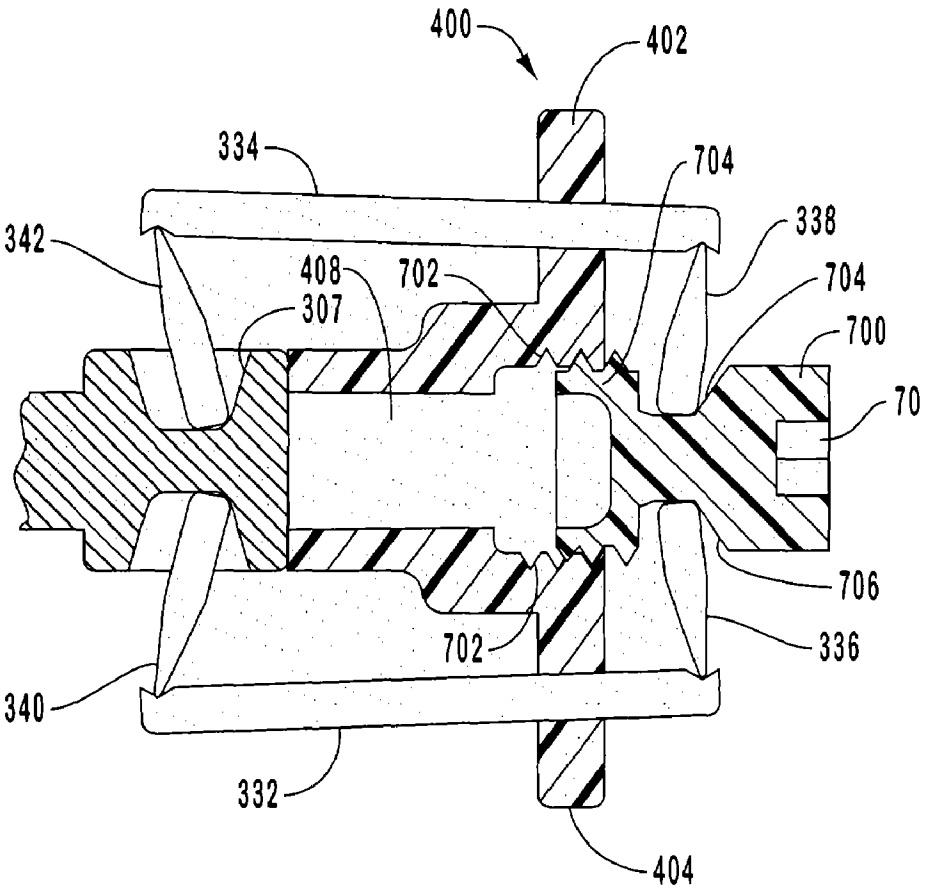

As illustrated in FIG. 5B, by increasing the tension on first resilient member 332 and second resilient member 334, the force exerted on first actuation leg 340 and second actuation leg 342 is also increased, effectively increasing the force exerted by first actuation leg 340 and second actuation leg 342 on shuttle member 302. As the force exerted by first actuation leg 340 and second actuation leg 342 on shuttle member 302 increases, the amount of force required to overcome the force exerted by first actuation leg 340 and second actuation leg 342 is also increased.

Due to the fact that the amount of air flow provided by an air pressure source through air inlet 20 is substantially constant, a greater amount of time is required to achieve the differential in air pressure required to overcome the increased force exerted on shuttle member 302 by detent mechanism 330. Due to the increased time required to achieve the air pressure differential between first compression chamber 110 and second compression chamber 120 to overcome the force exerted by detent mechanism 330, the rate of oscillation of shuttle member 302 is decreased. Moreover, this decrease is achieved without regulating the pressure of the air or the rate of flow of the air supplied to the oscillator. The decrease in the rate of oscillation of shuttle member 302 results in a decrease in the rate of cycling of pump 100.

Thus by manipulating cycle control member 700, the rate of oscillation of oscillator 1 can be increased or decreased, thereby allowing the user to control the cycling of pump 100. By utilizing a cycle controller 70 in connection with detent member 330, the need for additional valves, or air controls, to control the rate of oscillation of oscillator 1 is obviated. Additionally, the user can control oscillation by manipulating a single control, without requiring manipulation of two or more controls that must be cooperatively calibrated.

Figure 6:
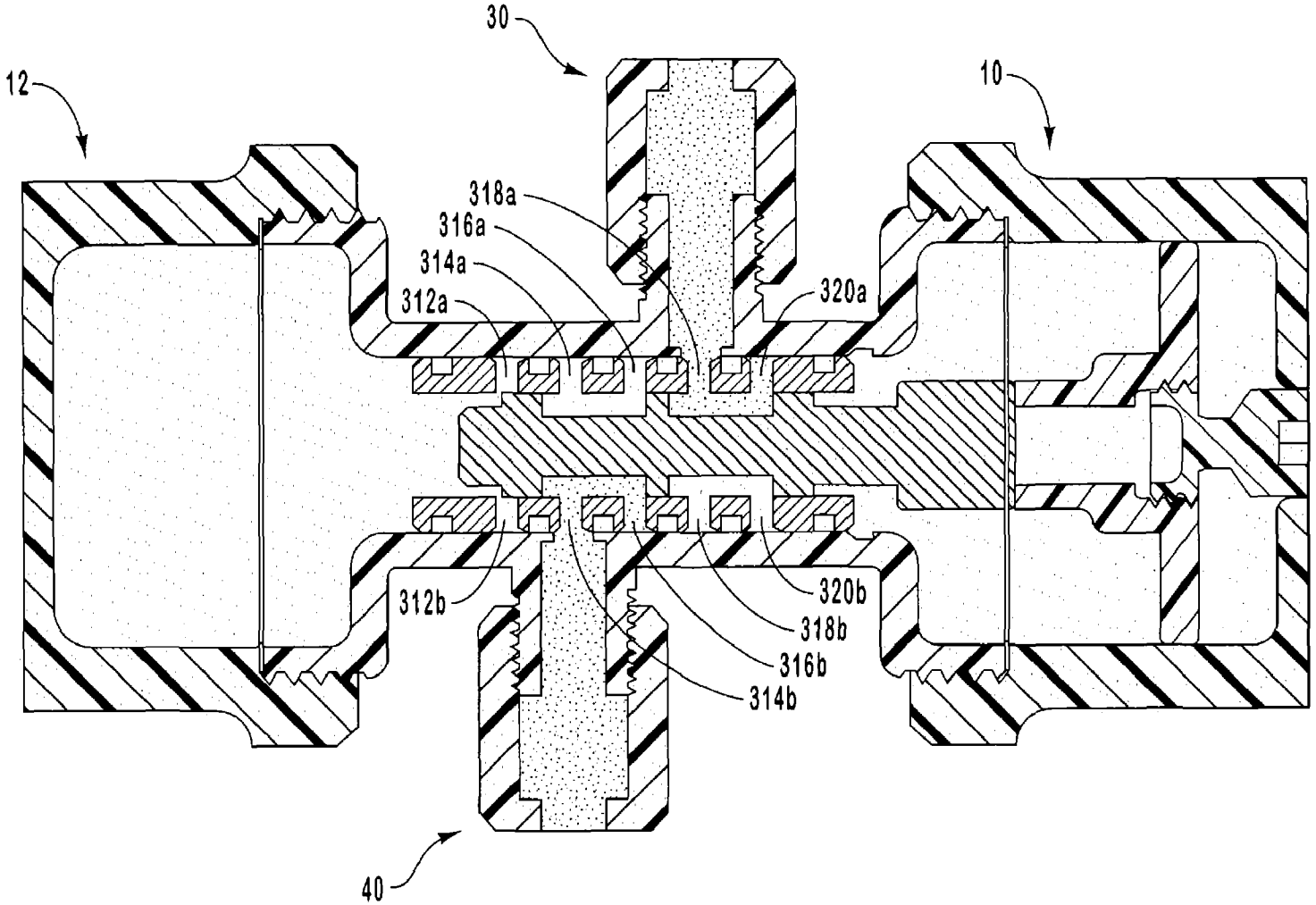
FIG. 6 is a top cut-away view of the oscillator illustrating the manner in which the shuttle member controls the flow of air pressure to the first and second supply ports according to one aspect of the present invention.

FIG. 6 depicts a cross section of a top view of oscillator 1, illustrating the manner in which shuttle valve 300 controls air flow to first supply port 30 and second supply port 40 of oscillator 1. In FIG. 6, shuttle member 302 is in a first position at its rightmost displacement. The position of second land 304 and third land 305 connects first supply port 30 with valve exhaust port 320 by means of valve pump supply port 318. Due to the fact that first pump head 102 of pump 100 is connected to first supply port 30, first pump head 102 is depressurized by means of exhaust port 320. The position of first land 303 and second land 304 results in a second supply port 40 being connected to an air pressure source via valve inlet port 316. Because second supply port 40 is connected to second pump head 104 of pump 100, second pump head is pressurized by means of valve pump supply port 314.

Oscillator 1 can be constructed of non-reactive materials required by many ultra-pure manufacture settings. The non-reactive materials from which oscillator 1 is constructed can be customized to the particular requirements of the application in which oscillator 1 is utilized. For example, in an application adapted for pumping a corrosive agent, oscillator 1 can be constructed of non-metal parts. Oscillator body 14, first chamber casing 112, and second chamber casing 122 can be constructed of a PFA Teflon material. Valve body 310 can be constructed of a ceramic material. First and second resilient members 332, 334 and shuttle member 302 can be constructed of PolyEtherEtherKetone (PEEK). Legs 336, 338, 340, and 342 can be constructed of the proprietary plastic material Delrin® of DuPont. The construction of oscillator 1 is not limited to the illustrated embodiment. A variety of types of materials can utilized without departing from the scope and spirit of the present invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An oscillator for use in controlling operation of a pump, comprising:

a first compression chamber;

a second compression chamber; and a valve having a shuttle member for controlling air flow and a detent mechanism for regulating oscillation of the shuttle member, wherein the shuttle member and the detent mechanism are configured such that the valve regulates operation of the oscillator without the use of additional valve.

2. The oscillator of claim 1, wherein the valve controls the rate of oscillation of the oscillator.

3. The oscillator of claim 1, wherein a constant air flow is supplied to both the first compression chamber and the second compression chamber, the air flow being alternately exhausted by the valve and detent to control the pneumatic pressure supplied by the oscillator to the pump.

4. The oscillator of claim 3, wherein the detent controls the rate of cycling of the pump.

5. The oscillator of claim 1, further comprising an air inlet port and one or more outlet ports.

6. The oscillator of claim 5, wherein the one or more outlet ports comprise an exhaust port, a first supply port, and a second supply port.

7. The oscillator of claim 6, wherein the first supply port and the second supply port are coupled to first and second heads of the pump so as to provide pumping force to the pump.

8. The oscillator of claim 7, wherein the shuttle valve further comprises a valve body.

9. The oscillator of claim 8, wherein the valve body includes a plurality of ports for regulating air flow in the oscillator.

10. An oscillator for controlling operation of a pump, the oscillator utilizing air flow for providing pumping force to the pump and for controlling cycling of the pump, the oscillator comprising:

a first compression chamber;

a second compression chamber;

a channel positioned between the first and second compression chambers; and a shuttle valve having at least a portion thereof positioned in the channel between the first and second chamber, the shuttle valve comprising:

a shuttle member adapted to control depressurization of the first and second compression chambers so as to create a differential in air pressure between the first and second compression chambers; and a detent mechanism flexibly coupled to the shuttle member so as to allow movement of the shuttle member only when the differential in air pressure reaches a specified level.

11. The oscillator of claim 10, wherein the shuttle member moves between a first and second position during a cycle of the oscillator.

12. The oscillator of claim 11, wherein the first position is adapted to pressurize the first compression chamber and depressurize the second compression chamber and the second position is adapted to depressurize the first compression chamber and pressurize the second compression chamber.

13. The oscillator of claim 12, wherein the shuttle member moves between the first and second position to create an oscillating differential in air pressure between the first compression chamber and the second compression chamber.

14. The oscillator of claim 10, wherein the detent mechanism comprises one or more resilient members.

15. The oscillator of claim 14, wherein the detent mechanism further comprises one or more actuation legs.

16. The oscillator of claim 15, wherein the one or more resilient members exert a force on the one or more actuation legs such that the one or more actuation legs exert a force on the shuttle member.

17. The oscillator of claim 16, wherein the force exerted on the shuttle member by the actuation legs allows movement of the shuttle member only when the differential in air pressure between the first and second compression chamber reaches a specified level.

18. The oscillator of claim 17, wherein the shuttle member remains in one of the first or second positions until the differential in air pressure between the first compression chamber and the second compression chamber exceeds the force inhibiting movement of the shuttle member.

19. The oscillator of claim 18, wherein the configuration of the detent mechanism ensures that the shuttle member will move to the alternative first or second position once the shuttle member is displaced a given amount from the first or second position.

20. The oscillator of claim 15, wherein the detent mechanism further comprises one or more pretension legs.

21. The oscillator of claim 20, wherein the pretension legs can be adjusted to vary the amount of force the one or more actuation legs exert on the shuttle member to permit a user to manually adjust the rate of oscillation of the shuttle member.

22. An oscillator for controlling operation of a pump, the oscillator utilizing air flow for providing pumping force to the pump and for controlling cycling of the pump, the oscillator comprising:

an oscillator body having a first and second compression chamber, and a channel between the first and second compression chambers;

a shuttle valve having a shuttle member for controlling air flow and a detent mechanism for controlling oscillation of the shuttle member; and a cycle controller corresponding with the detent mechanism, the cycle controller permitting a user to change the rate of oscillation of the shuttle member such that the need for additional valves or controllers for regulating the rate of oscillation is obviated.

23. The oscillator of claim 22, wherein the cycle controller can be manipulated to control the rate of oscillation of the shuttle member.

24. The oscillator of claim 23, further comprising indicia for indicating the direction in which to manipulate the cycle controller to increase or decrease the rate of oscillation of the oscillator.

25. The oscillator of claim 20, wherein the cycle controller is coupled to one or more pretension legs of the detent mechanism.

26. The oscillator of claim 25, wherein manipulation of the cycle controller allows a user to increase or decrease the amount of pressure exerted on shuttle member by the actuation legs.

27. An oscillator for controlling operation of a pump, the oscillator utilizing air flow for providing pumping force to the pump and for controlling cycling of the pump, the oscillator comprising:

a first compression chamber;

a second compression chamber;

a channel between the first and second compression chambers;

an air pressure source providing a consistent air flow to the first and second compression chambers; and a shuttle valve positioned internal to the channel, the shuttle valve comprising:

a shuttle member having a first position adapted to pressurize the first compression chamber and depressurize the second compression chamber and a second position adapted to depressurize the first compression chamber and pressurize the second compression chamber so as to create a differential in air pressure between the first compression chamber and the second compression chamber, the shuttle member having a rate of oscillation between the first and second positions; and a detent mechanism for inhibiting movement of shuttle member between the first and second positions until a desired differential in air pressure between the first compression chamber and the second compression chamber has been reached; and a cycle controller coupled to the detent mechanism, the cycle controller being adapted to change the desired differential in air pressure so as to permit a user to change the rate of oscillation of the shuttle member.

28. The oscillator of claim 27, wherein the desired differential in air pressure controllable by manipulating cycle controller.

29. The oscillator of claim 27, further comprising indicia for providing a visual indication of the manner in which to manipulate the cycle controller to increase or decrease the rate of oscillation.

30. The oscillator of claim 29, wherein the indicia comprises an electrical device coupled to a display.

31. The oscillator of claim 30, wherein the indicia indicates the actual oscillation of the oscillator.

32. The oscillator of claim 30, wherein the indicia indicates the estimated rate of oscillation of the oscillator.

* * * * *